United States Patent [19]

Hughes

[11] 4,240,583

[45] Dec. 23, 1980

[54] LOW COST, HIGHLY VERSATILE SELF-PUMPING VEHICLE TYPE LIQUID SPRAYER

[75] Inventor: Gary W. Hughes, Little Rock, Ark.

[73] Assignee: Chemical Applicator, Inc., Little Rock, Ark.

[21] Appl. No.: 28,294

[22] Filed: Apr. 9, 1979

[51] Int. Cl.[3] ..... B05B 9/06

[52] U.S. Cl. ..... 239/157; 239/588; 222/613

[58] Field of Search ..... 239/157, 156, 273, 286, 239/588, 287; 222/613, 614, 620, 621

[56] References Cited

U.S. PATENT DOCUMENTS

| | | | |
|---|---|---|---|
| 2,491,818 | 12/1949 | Lapp | 239/157 |
| 2,607,336 | 8/1952 | Everts | 239/286 X |
| 2,703,256 | 3/1955 | Mascaro | 239/157 X |
| 3,235,187 | 2/1966 | Merritt | 239/588 |
| 3,534,533 | 10/1970 | Looma | 239/157 X |
| 3,976,231 | 8/1976 | Betulius | 239/157 |

*Primary Examiner*—Robert B. Reeves
*Assistant Examiner*—Gene A. Church
*Attorney, Agent, or Firm*—Sughrue, Rothwell, Mion, Zinn and Macpeak

[57] ABSTRACT

A sheet metal vehicle chassis supporting a container of liquid to be sprayed is provided on at least one of its wheels with cam rollers fixed to the wheel for rotation. The roller cams compress a loop of pump hose at spaced locations to siphon liquid from the container by way of a suction hose and discharge liquid through a discharge hose connected to respective hose barbs projecting through a hose barb mounting plate overlying the roller cams and having opposite ends coupled to said loop. An orthogonally adjustable nozzle support tube, connected at one end to the discharge hose, insures a varying density and pattern spray of liquid on the underlying floor during movement of the vehicle in self-pumping operation over said floor.

7 Claims, 9 Drawing Figures

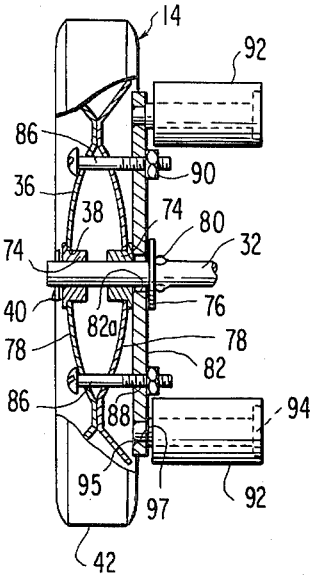
FIG. 6
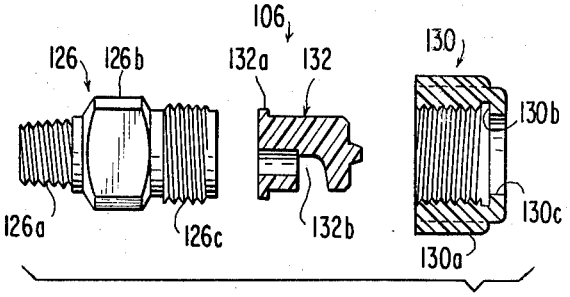
FIG. 7
FIG. 3
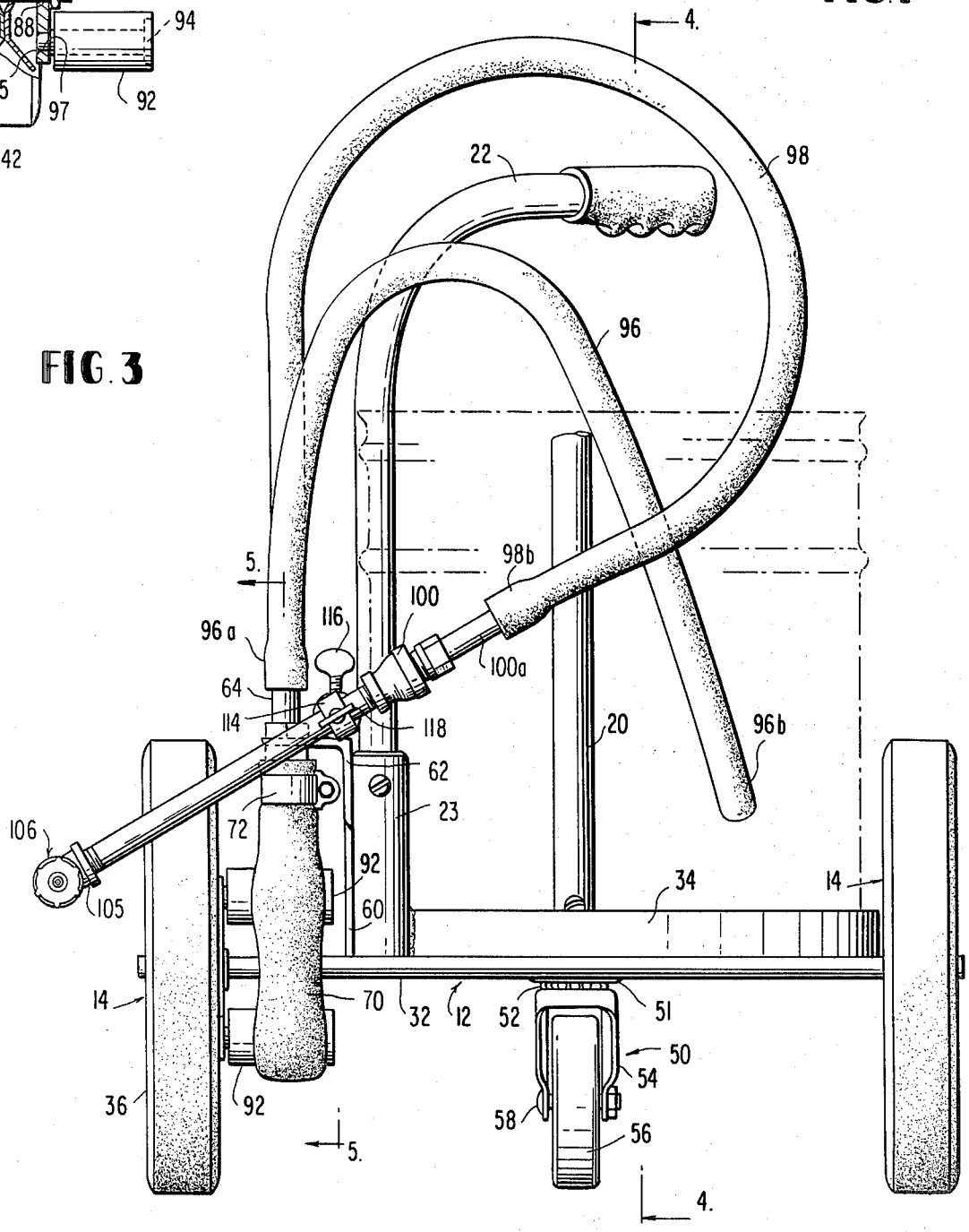

LOW COST, HIGHLY VERSATILE SELF-PUMPING VEHICLE TYPE LIQUID SPRAYER

FIELD OF THE INVENTION

This invention relates to self-pumping vehicle liquid sprayers for spraying liquid chemicals and the like over a surface traversed by the sprayer, and more particularly, to a low cost sprayer achieving uniform liquid spraying of the surface traversed with adjustable rate, density, and pattern spray.

BACKGROUND OF THE INVENTION

Conventionally, chemicals such as curing compounds, sealers and concrete hardeners have been sprayed by building contractors and the like over surfaces to be treated by the utilization of small manually carried liquid spray units in much the same form as hand carried fire extinguishers with extremely limited liquid capacity. The use of such hand carried sprayers has proved to be both time consuming to the contractor and permits no regulation of the density of the spray pattern or uniform application of the chemicals.

There has developed a vehicle type sprayer employing a self-pumping action by effecting the localized compression of a flexible tube or hose bearing the chemical and leading from a supply tank to a spray nozzle. U.S. Pat. No. 2,703,256 issuing Mar. 1, 1955, is representative of such sprayers.

The present invention constitutes an improvement in this art and overcomes not only the difficulties and problems associated with manually carried hand held sprayers with the operator simply directing the nozzle bearing hose or wand towards the surface being sprayed and manually traverses that surface to deposit an irregular liquid spray coating, but constitutes in multiple embodiment fashion an improved, low cost, highly versatile sprayer, permitting the sprayer to accommodate itself to various sizes and configurations for the tank bearing the liquid to be sprayed, permitting height and lateral adjustment of the spray nozzle or nozzles, and the density of the spray pattern at the point of impact with the surface to be treated and by way of the use of different size nozzle tips. In addition, the unit bears appropriate handles for both pushing the vehicle to effect pumping and spraying action and lifting of the unit for transport purposes and the like.

It is, therefore, an object of the present invention to provide an improved, highly efficient commercial floor or other surface chemical applicator which results in less waste of material, is easily assembled and disassembled and transported, provides uniform coverage with varying spray width and spray location.

It is a further object of the present invention to provide a chemical spray applicator of this type in which the spray nozzle is adjustable orthogonally to vary the spray pattern and the density of the spray at point of contact and to permit an increase in the spray width per nozzle without having the spray of chemicals from various nozzles overlapping each other.

SUMMARY OF THE INVENTION

The invention is directed to an improved, low cost, highly versatile, self-pumping vehicle type liquid sprayer for spraying liquid over a surface traversed by the sprayer. The sprayer comprises a vehicle chassis which supports a container of liquid to be sprayed.

Wheels are mounted to the chassis for rotation about their axes to effect movement of the container over the surface to be sprayed. A pump mounting bar is fixed to the chassis and extends to one side of one of said wheels. A hose barb mounting plate overlies the axle to the same side of the wheel. A roller cam mounting plate is mounted to the wheel for rotation therewith, extends perpendicular to the axle and intersects the axle. Roller cams are mounted to the plate on opposite sides of the axle and rotate circumferentially about the axle. Hose barbs mounted to the hose barb mounting bar project therethrough and support a flexible pump hose which is fixed at respective ends to respective barbs on the side of the bar facing the axle. The pump hose extends about the roller cams and is in contact therewith and is of such a length that the roller cams compress the pump hose locally at axially spaced positions. A suction hose is coupled at one end to one of the barbs with the other end operatively opening to the liquid in the container to be sprayed. A discharge hose is connected at one end to the other of the barbs and terminates at a spray nozzle assembly which is mounted to the chassis for longitudinal and vertical adjustment to vary the height of the nozzle and its lateral position with respect to the chassis and thus the spray pattern and its density such that when the chassis is moved over the surface to be sprayed, rotation of the wheels causes the roller cams in compression to move along the pump hose to remove liquid from the container by suction and to force it through the discharge hose and the spray nozzle.

Preferably, the chassis carries a mounting sleeve fixed horizontally to the chassis and a horizontal adjustment rod is slidably mounted within the sleeve and may be clamped at an axially adjustable position to define a vertical plane for the nozzle spray. The horizontal adjustment rod mounts a rigid nozzle tube for sliding adjustment at the forward end of that rod at right angles thereto for varying the height of the nozzle relative to the floor. The horizontal adjustment rod may be rotated within its sleeve to effect angular adjustment of the nozzle relative to that sleeve. Preferably, the chassis bears laterally opposed wheels. At least one of the wheels bears the roller cams. A push handle may be fixed to the chassis at the rear for permitting push movement of the vehicle sprayer across the surface to be coated. An L-shaped carrying handle is fixed in upright position to the chassis adjacent the pump mounting bar for permitting the sprayer and the container of liquid to be manually lifted for ready transport. Preferably, the nozzle assembly comprises a nozzle body threaded to the rigid nozzle tube through a threaded tubular fitting and terminates in a threaded nozzle cap. A replaceable nozzle tip is borne by the nozzle body and is locked thereto by the nozzle cap.

In an alternate form, the chassis bears an inverted U-shaped pusher bar at the rear and each of the pump mounting bars for adjacent opposed lateral wheels, bears paired hose barbs and both wheels carry roller cams in contact with given pump hoses mounted to the bottom of respective hose barb mounting plates such that the unit comprises dual pumps fed separately from the liquid supply container and leading to separate adjustably mounted spray nozzles on respective sides of the sprayer.

BRIEF DESCRIPTION OF THE DRAWINGS

FIG. 3 is an end view of the embodiment of the invention shown in FIGS. 1 and 2.

FIG. 6 is a top plan view, partially broken away and partially in section, of one of the wheel assemblies of the sprayer of FIGS. 1–5.

FIG. 7 is an exploded view of the nozzle assembly employed in the sprayer of the present invention.

DESCRIPTION OF THE PREFERRED EMBODIMENTS

Figure 1:
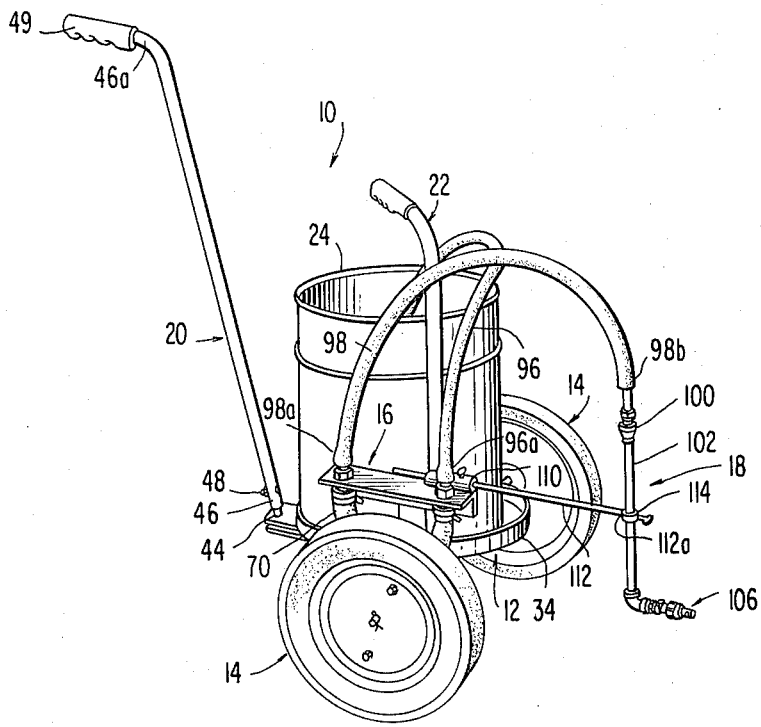
FIG. 1 is a perspective view of the improved low cost, highly versatile, self-pumping vehicle type liquid sprayer of the present invention.
Figure 2:
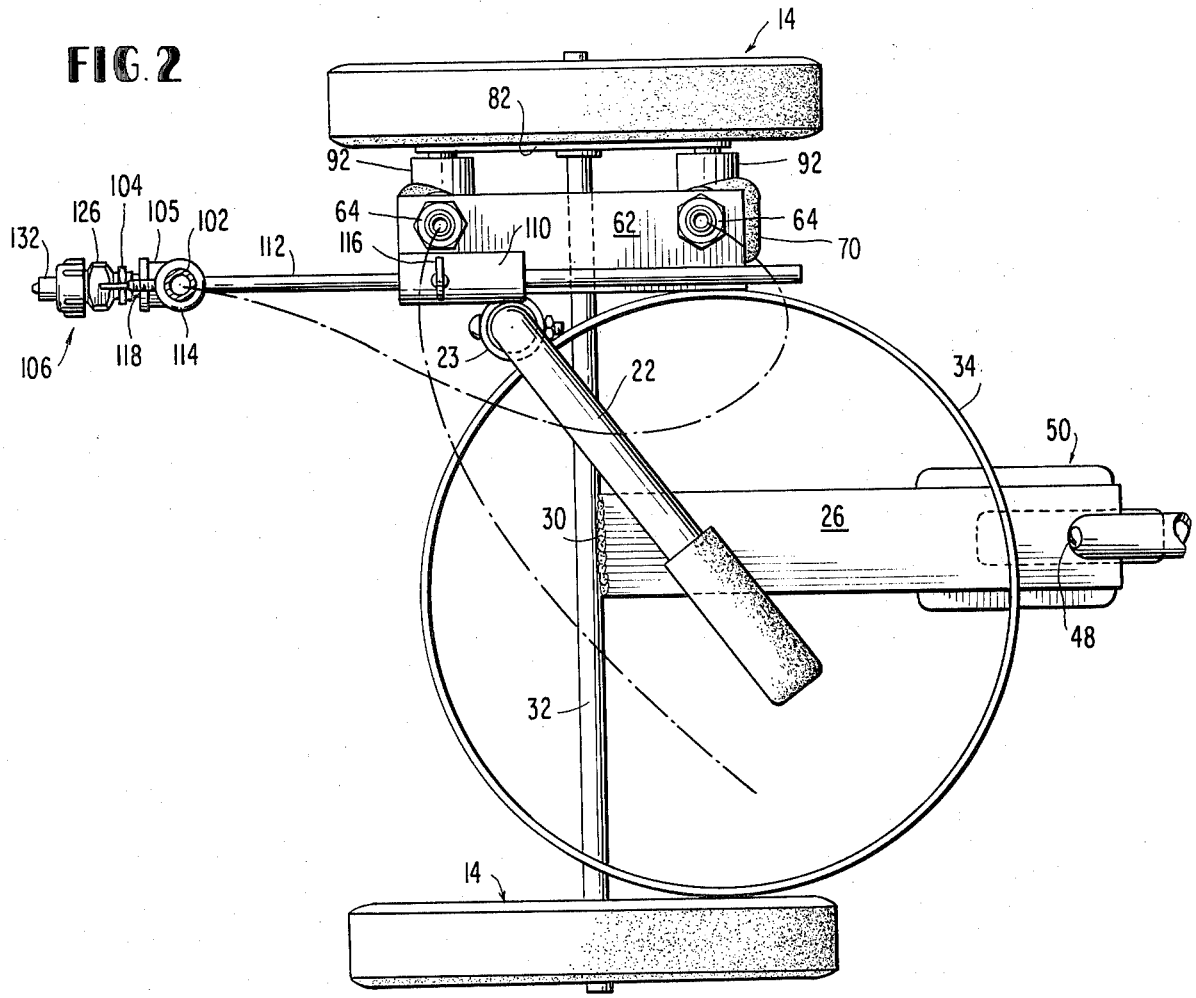
FIG. 2 is a top plan view of the embodiment of the invention shown in FIG. 1.

Reference to the drawings discloses two embodiments of the present invention. In both embodiments, like elements bear like numerical designations.

FIGS. 1–7 inclusive are directed to a first embodiment of the invention, wherein the sprayer indicated generally at 10 comprises as principal components a vehicle chassis or frame indicated generally at 12, laterally opposed vehicle wheel assemblies indicated generally at 14, a pump mounting bar assembly indicated generally at 16, an orthogonally adjustable spray assembly indicated generally at 18, a push handle indicated generally at 20, and a carrying handle indicated generally at 22. Further, the chassis supports an open top supply container or drum 24 bearing a source of liquid (not shown) to be sprayed by way of the nozzle assembly 18.

While the container 24 is shown as an upwardly open drum, removable from the unit by simply lifting it off of the chassis or frame assembly 12, it may be a fixed member, and it may be closed at the top. Further, while a suction hose 96 to the pump is shown as emerging from the open top of the supply container 24, one end of the suction hose could be coupled to the bottom of the supply container to provide positive priming of the pump.

With respect to the illustrated embodiment in FIGS. 1–7, the frame or chassis 12 comprises a flat horizontal metal plate 26 welded at one end as at 30 to a right angle, transversely extending metal rod axle 32 forming a T frame portion. A circular steel band 34 is welded at its lower edge at points of contact between the steel band and plate 26 and axle 32. The wheel assemblies 14 preferably comprise sheet metal, side wheels 36 which are apertured at their centers as at 38 through which protrudes the ends of the axle 32. The side wheels 36 include bearings 74 for rotation about the fixed axle 32, the wheels being maintained on the axle by way of cotter pins 40. Pneumatic tires 42 are provided for each of the side wheels 36. Carrier handle 22 projects from fixed sleeve 23.

Preferably, the unit is pusher operated, and in that respect, the pusher handle 20 is mounted to the rear of plate 26. The plate bears an upwardly inclined handle mounting rod or post 44 which is welded to the upper surface of the plate 26 and is inclined at an angle with respect to that plate and directed rearwardly. The post 44 is of a diameter slightly smaller than the internal diameter of hollow push handle tube 46 so as to receive the lower end of the handle tube 46. The handle tube 46 may be bolted by means of the bolt and nut assembly 48 to the post 44. The push handle 20 terminates at its upper end in a horizontal rearwardly directed terminal portion **46*a* of the tube, which bears a grip 49. Underlying the plate 26 at its rear end, is a caster assembly 50 including a ball bearing as at 52 mounted between a mounting plate 51 and a yoke 54. Yoke 54 is mounted for rotation about a vertical axis at right angles to the plate 51. The caster wheel yoke 54 carries a caster wheel 56 mounted for rotation about a vertical axis by way of axle 58. Thus, both the side wheels 36 and the caster wheel 56 support the liquid container 24 and the elements of the sprayer. The caster wheel 56 is free to pivot about the vertical mounting axis of the yoke 54 and essentially tracks or follows the vehicle under forces applied to the push handle 20** by the operator.

A pump mounting bar 60 is welded to the frame or chassis 12, extending vertically upwardly from axle 32 to the side of one of the wheel assemblies 14. It may be provided integrally or have welded thereto, as shown, at its upper end a horizontal hose barb mounting bar 62. In the illustrated embodiment, bar 62 constitutes a metal angle bar and is welded to one face of the vertical pump support mounting plate 60 at the upper end thereof. One portion of the bar 62 extends transversely of the frame towards a given side wheel 36 and overlies a portion of the axle 32. The function of the hose barb mounting bar 62 is to fixedly support a pair of hose barbs 64 at opposite ends of the bar 62. The bar 62 bears circular holes within the same and the hose barbs 64 comprise, FIG. 5, threaded tubular portion **64*a* projecting through the holes and bearing a threaded cylindrical element or hose fitting 66 having one end which abuts the bottom of bar 62. An integral lock nut 68 abuts the top of bar 62 such that when tubular element 66 constituting the hose fitting for the pump hose 70 is threaded to portion 64*a* of the hose barb 64 which projects through the hole within bar 62, the hose barb 64 is fixed thereto and provides projecting upper and lower tubular portions to which pieces of hose may be readily connected. The pump hose 70, which is properly sized, of given flexibility, and of predetermined length, is clamped to the tubular hose fitting elements 66 by conventional hose clamps as at 72 to form seal tight connections between the hose and the hose barbs 64 on the bottom of the hose barb mounting bar 62**.

In the embodiment of FIGS. 1–6, pumping is achieved by the forced rotation of one of the pump side wheels 36, in this case the left hand side wheel 36 when the sprayer is viewed from the front. By reference to FIG. 6, it may be seen that the side wheel 36 is of two part sheet metal construction with the paired bearings 74 mounted within holes 38 of oppositely bowed sheet metal elements 78. These bearings 74 receive the projecting ends of the axle 32, the axle 32 being struck or deformed locally at 80 so as to form a stop for the wheel 36 via washer 76, preventing axial movement toward the center of the vehicle chassis, while the cotter pins 40 prevent the side wheels from coming off the ends of the axle 32. A roller cam mounting plate 82 is locked to one wheel 36 for rotation therewith and about the axis of axle 32. In that respect, the roller cam mounting plate 82 bears a central opening as at 82*a* through which axle 32 passes.

The side wheel 36 sheet metal members 78, mount bolts 86 which protrude from one side of wheel 36 and are received within circular holes 88 of plate 82. Plate 82 is bolted to the inside of the wheel 36 by way of nuts 90 carried by the threaded end portions of the bolts 86. Further, roller cams 92 are mounted for rotation about their axes by way of headed pins 94 which are staked as at 95 to the plate 82 after having reduced diameter portions positioned within holes 97 at the outboard ends of the plate 82. The roller cams 92 constitue cylindrical members which freely rotate about their axes and which contact and locally, progressively compress the pump hose 70 at two spaced locations as the wheel 36 and the plate 82 rotate in unison. The pump hose 70 for accurately controlled performance has an internal diameter which is critical, has a wall thickness which is critical and is formed of a material whose type and durometer is critical. Preferably, a durometer of 25 to 30 is best for a pump hose to achieve performance for most chemicals being sprayed. Further, the pump hose itself must be made of a material which stands the effect of the various chemical liquids which are subjected to that hose. The heavier the viscosity of the material being pumped, the more difficult it is to achieve pumping. Heavier viscosity materials may require attachment of a steel band to encircle the pump hose to insure complete compression of the pump hose and prevent the chemical material from leaking by or expanding the hose, thereby providing a positive pump action.

Figure 4:
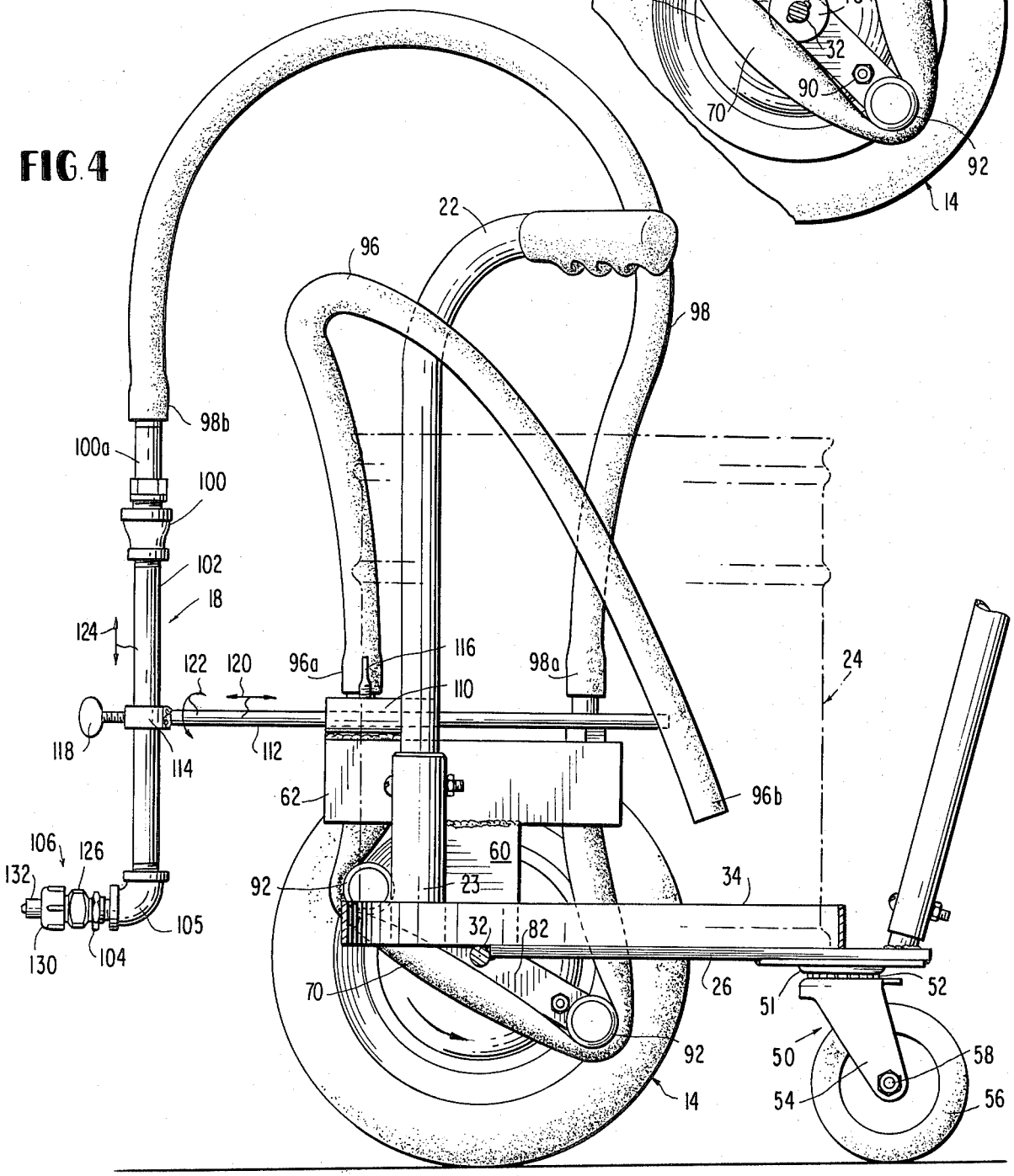
FIG. 4 is a vertical sectional view of a portion of the sprayer of FIG. 3, taken about line 4—4.

As mentioned previously, one of the hose barbs 64 insertably receives one end 96*a* of a suction or siphon hose 96 whose opposite end 96*b* may be submerged within the liquid L within container 24, FIG. 4. Each hose barb 64 is provided with a portion 64*b* consisting of a series of tapered segments forming serrations which act to frictionally grip and maintain the end 96*a* of the suction hose 96 on the hose bar in a fluid tight manner, but permitting the removal and replacement of hoses as necessitated by the corrosive effects of the chemical acting on the hose. Adhesives may be employed for bonding the hoses to the barbs.

Figure 5:
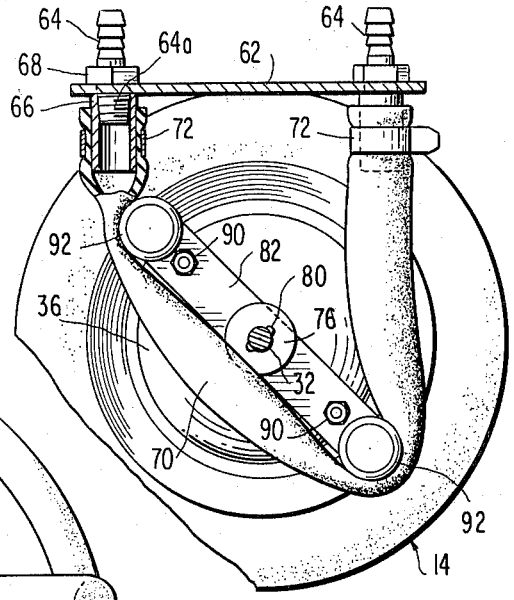
FIG. 5 is a vertical sectional view of a portion of the sprayer shown in FIG. 3, taken about line 5—5.

On the opposite end of the plate 62, FIG. 5, a second hose barb 64 acts to receive one end 98*a* of a discharge hose 98 whose opposite end is sealably connected via a threaded pipe fitting 100, at 93*b* FIG. 1, to a rigid hollow tube 102 formed of metal or plastic and to which is mounted by way of fittings a nozzle assembly 106. The fitting 100 includes a short tubular portion 100*a* which may be barbed in the same manner as hose barb 64 so as to frictionally grip the concentric and slightly expanded end 98*b* of the discharge hose 98.

An important aspect of the present invention is the nature in which the nozzle assembly 106 may be adjusted in terms of vertical height, angular position with respect to the chassis and longitudinal position relative to that assembly, that is, axially in the direction of movement of the vehicle sprayer. In that respect, the hose barb mounting bar 62 has welded to the upper surface thereof, a metal sleeve 110 oriented horizontally, which slidably receives the forward horizontal adjustment rod 112. Rod 112 is of a diameter slightly less than the bore of sleeve 110 and is provided at its forward end 112*a* with a fixed ring or collar 114 having a diameter slightly larger than the diameter of the tube 102. The tube 102 is slidably received therein. The sleeve 110 is provided with a thumb screw as at 116 which is threaded to that member and at right angles to the axis of the sleeve and whose inner end frictionally contacts the periphery of the rod 112 to frictionally lock the rod axially within the sleeve 110. Further, the ring or collar 114 is provided with a thumb screw 118 which is threaded to that member and whose inner end contacts the periphery of the tube 102 to fixedly locate that tube axially relative to ring 114 and at right angles to the axis of rod 112. By loosening the set screw 116, the rod 112 may be shifted axially as indicated by arrow 120 and/or rotated as indicated by arrows 122, FIG. 4, so as to determine both the longitudinal position fore and aft of the apparatus of the nozzle assembly 106, as well as its angle of inclination relative to sleeve 110. By loosening of set screw 118, the tube 102 may be shifted axially within the ring or collar 114 as indicated by arrow 124 to set the vertical height should the ring 114 be oriented horizontally. With the shaft 112 rotated 90°, it may determine the horizontal or lateral position of the nozzle assembly 106. The versatility in positioning of the spray nozzle assembly 106, the variation in spray patterns achieved, and the density of the spray on the contact surface may be readily appreciated by reference to FIG. 4 and arrows 120, 122 and 124.

Further, by reference to FIG. 7, it may be seen that the tube 102 terminates at one end in an elbow 105 threaded at one end to the tube 102, and threaded at the other end, via a threaded fitting 104, to end 126*a* of nozzle body 126 which is tubular in form and which forms one element of assembly 106. Body 126 is provided centrally with a hexagonal outer surface portion as at 126*b* and terminates at oppositely threaded end 128*c*. Threaded end 128*c* receives a tubular nozzle cap 130 which is sized to fit the same. Further, the nozzle assembly 106 includes a formed replaceable nozzle tip as at 132 having one end which abuts the end of the threaded nozzle body portion 128*c* and which is locked thereto by way of the internal threads 130*a* of the nozzle cap 130. The replaceable nozzle tip 132 has a radially enlarged flange 132*a* which abuts an end wall 130*b* of the nozzle cap such that the major portion of the nozzle tip protrudes through a central opening 130*c* within the nozzle cap and permits the radial spray opening 132*b* to be exposed to produce a downwardly distributed spray pattern for the liquid being pumped. Depending upon the viscosity of the material, the height of the nozzle assembly from the surface being coated, the speed of movement of the vehicle type sprayer and the like, various different tips having different diameter flow passages and spray characteristics may be singularly mounted to the nozzle body by way of the threaded nozzle cap 130 by simply threadably removing the nozzle cap 130 from the nozzle body threaded portion 128*c*, removal of the nozzle tip 132 and replacement of the same. For instance, typical operations involved the selection of a nozzle tip to square feet per gallon requirements, the adjustment of the vertical height for the nozzle assembly to obtain a 20 inch wide spray pattern per nozzle with testing involving the utilization of the actual chemical to be sprayed and coated by employing a one gallon container, maintaining a 20 inch wide spray on a single nozzle only and measure of the width times the length of material applied and dividing this by twelve for actual coverage. If multiple nozzles and pumps are employed as in the embodiment of FIGS. 8 and 9, both nozzles are set at a common height and shifted laterally to insure against spray pattern overlap. The pump (or pumps) works by rotation of side wheel roller cams compressing the rubber or like material hose to create a siphon action and a positive movement of the liquid being pumped in the direction of the nozzle assembly at the end of the discharge hose. By simply loosening of the set screws, the position of the nozzle assembly 106 may be adjusted vertically, angularly and laterally with the set screws 116 and 118 being then reversely rotated to lock rod 112 and tube 102 respectively within sleeve 110 and ring or collar 114.

Figure 8:
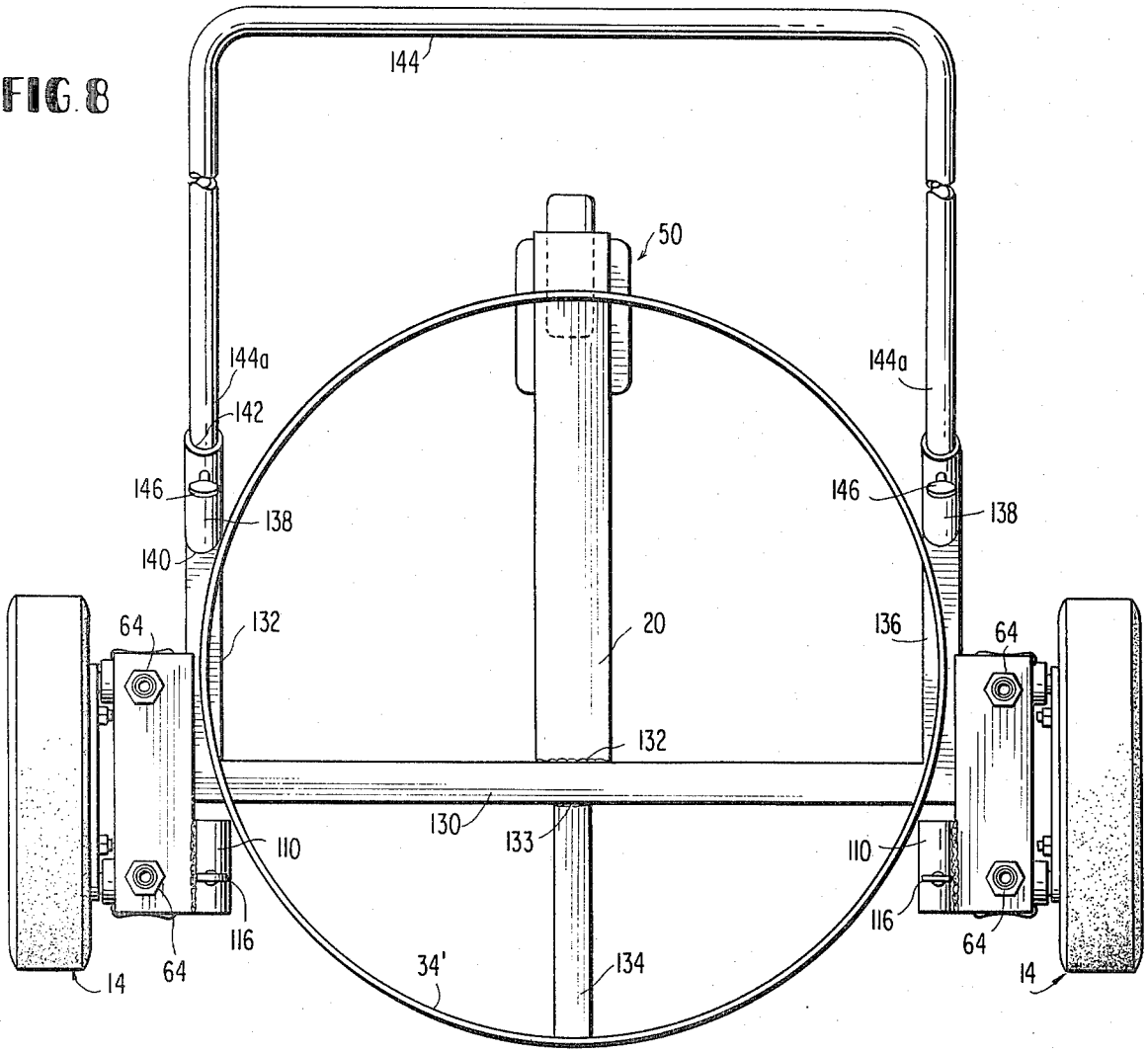
FIG. 8 is a top plan view of an alternate embodiment of the invention.
Figure 9:
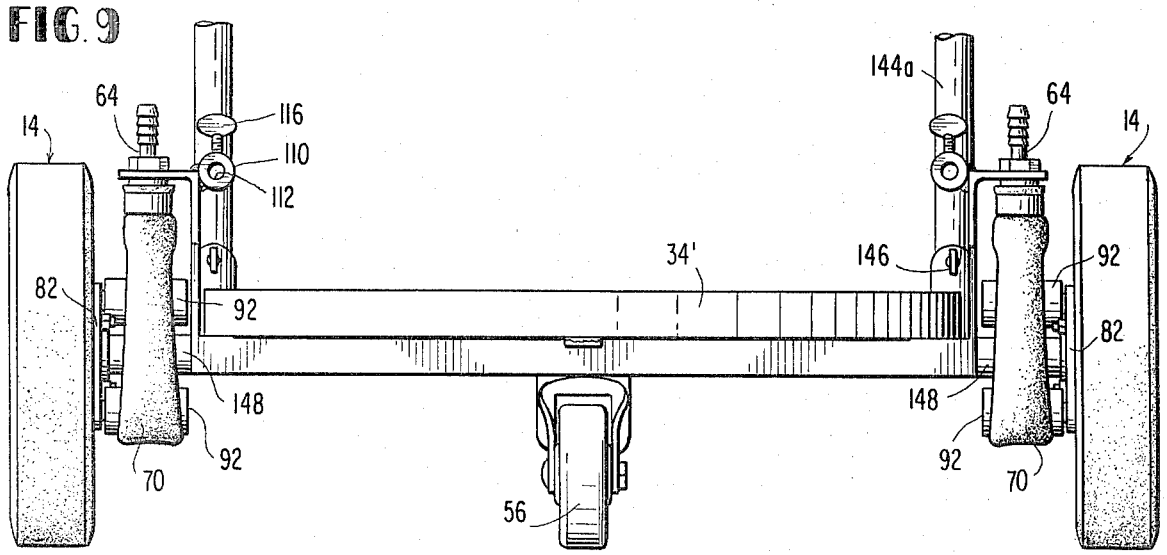
FIG. 9 is an end view of a portion of the sprayer of FIG. 8.

Referring next to the embodiment of the invention of FIGS. 8 and 9, in which like elements bear like numerical designations, in this case the frame or chassis 12' is defined by a relatively wide, horizontal plate 20 extending rearwardly from crossbar 130. Elements 20 and 130 are formed of metal and welded together at 132. Further, a narrow forwardly extending plate 134 is welded at one end as at 133 to the crossbar 130 forming with elements 20 and 130 a frame portion of cross configuration in plan. Further, at opposite ends of the crossbar 130, there is welded to that member and extending rearwardly therefrom narrow horizontal plates 136 which terminate remote from the crossbar 130 in a pair of upwardly oblique tubular pusher bar mounts or sleeves 138, the sleeves being welded to the top of plates 136 as at 140. The sleeves 138 have a bore 142 slightly larger than the diameter of the inverted U-shaped pusher bar 144 with the sides 144*a* of the pusher bar received within sleeves 136. Further, the sleeves bear set screws as at 146 for locking the inserted ends of pusher bar 144.

In similar fashion to the first embodiment, an annular metal band formed of steel or the like as at 34', is welded on its lower edge to the frame or chassis members as at 20, 130, 134, and 136, thereby defining an area within which may be received the lower end of an upstanding drum, barrel or similar liquid container in the manner of drum 24 of the first embodiment.

In order to double the width of the spray pattern and the capacity of the sprayer, both lateral or side wheel assemblies 14 in this embodiment function additionally to effect pumping of the liquid from the container (not shown) through a pair of spray assemblies identical to those at 18 in FIG. 1, each borne by a rod 112 which is slidable within a sleeve 110 fixed relative to the frame and bearing a thumb screw 116 for fixing of the rod at an axially adjusted position in the same manner of the embodiment of FIG. 1. In that respect, the crossbar 130 terminates at its outboard end in cylindrical axle portions 148, terminating further in reduced diameter axle tips upon which the side wheels 36 are mounted in the same fashion that the side wheels 36 are mounted for rotation on the outboard ends of axle 32 in the embodiment of FIG. 1. Each of the side wheels bears a pair of roller cams rotatable about their axes as at 92, and being mounted to the wheels by way of its roller cam mounting bar 82, the roller cams contacting the inside of the pump hose 70. Further, pump mounting bars 60 are welded to the crossbars 130 and extend vertically upwardly therefrom, terminating in hose barb mounting bars 62 which bear the hose barbs 64 in the identical fashion to the prior embodiment. As seen, hose clamps 70 clamp the hose at opposite ends to those portions underlying mounting plates 62 of respective hose barbs 64. The metal sleeves 110 are welded, in this case, to the side of the mounting bars 62 rather than the tops, but extend horizontally and function to receive the horizontal adjustment rods 112 which are locked by the set screws 116. Further, in the same manner as the embodiment of FIG. 1, the forward barb 64 bears on each side a suction hose (not shown) in the same manner as the embodiment of FIG. 1, with its opposite, free end disposed within the drum of liquid to be sprayed (not shown).

Further, the upper portion of the trailing or rearward hose barb 64, above each mounting bar 62, receives one end of the second hoses on each side, leading to its nozzle assembly (not shown), identical to the nozzle assembly 106 of FIG. 1 and which is supported in orthogonally adjustable position by way of a horizontal adjustment rod 112. In all other respects, the second embodiment functions in the manner of the first embodiment, with the exception that the spray pattern is doubled in width, the capacity of the drum mounted to the chassis is increased, and the sprayer will function to coat a larger surface area during its transport than that of the smaller capacity first embodiment machine.

Changes and variations may be made in the embodiment of FIGS. 8 and 9 in similar fashion to those discussed with respect to the embodiment of FIGS. 1–7 inclusive.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In a self-pumping vehicle type liquid sprayer for spraying liquid through at least one spray nozzle assembly over a surface traversed by the sprayer from a container of liquid carried thereby and including a vehicle chassis supporting said container of liquid, side wheels mounted to the chassis for rotation about their axes to effect movement of the chassis over the surface to be sprayed, roller cam pump means carried by said sprayer and operated by vehicle wheel movement to pump liquid from the container to sprayer means carried thereby, the improvement wherein:

a transverse axle is carried by said chassis, side wheels are mounted to the ends of said axle on opposite sides of said chassis, a roller cam mounting bar is mounted to at least one of said wheels for rotation therewith, said roller cam mounting bar intersecting the axle, roller cams are mounted to the bar for rotation about their axes on opposite sides of said axle and for rotation with said at least one side wheel circumferentially about said axle, a vertical pump mounting bar is fixed to said chassis and extends vertically upwardly from said axle on the same side of said wheel as said roller cam mounting bar but spaced therefrom, a horizontal hose barb mounting bar is fixed to the upper end of said pump mounting bar and extends across said axle to overlie the axle to the same side of said wheel as said roller cam mounting bar, a pair of hose barbs are fixedly mounted to the hose barb mounting bar and project therethrough, a flexible pump hose encircles said roller cams and is coupled at its ends to given ends of the hose barbs projecting through said hose barb mounting plate at axially spaced positions, a suction hose is coupled at one end to the other projecting end of one of said barbs and having the other end of said suction hose opening to the liquid in the container to be sprayed, a discharge hose is connected at one end to the end of said other barb, and wherein said at least one spray nozzle assembly includes a spray nozzle and means for mounting said spray nozzle to said horizontal hose barb mounting bar for effecting orthogonal adjustment of said spray nozzle to vary the height of said nozzle and its lateral position with respect to said chassis and thus the spray pattern and its density, and means for connecting the other end of said discharge hose to said spray nozzle assembly for causing pumped liquid under pressure to spray from said spray nozzle, whereby rotation of said wheels causes the roller cams in compression to move the points of compression of said pump hose along said pump hose to force liquid from the container by suction and by pressure through the discharge hose and said spray nozzle.

2. In a self-pumping vehicle type liquid sprayer for spraying liquid through at least one spray nozzle assembly over a surface traversed by the sprayer from a container of liquid carried thereby and including a vehicle chassis supporting said container of liquid, side wheels mounted to the chassis for rotation about their axes to effect movement of the chassis over the surface to be sprayed, roller cam pump means carried by said sprayer and operated by vehicle wheel movement to pump liquid from the container to sprayer means carried thereby, the improvement wherein:

a transverse axle is carried by said chassis, side wheels are mounted to the ends of said axle on opposite sides of said chassis, a roller cam mounting bar is mounted to at least one of said wheels for rotation therewith, said roller cam mounting bar intersecting the axle, roller cams are mounted to the bar for rotation about their axes on opposite sides of said axle and for rotation with said at least one side wheel circumferentially about said axle, a hose barb mounting bar is fixed to said chassis and overlying the axle to the same side of said wheel as said roller cam mounting bar, a pair of hose barbs are fixedly mounted to the hose barb mounting bar and project therethrough, a flexible pump hose encircles said roller cams and is coupled at its ends to given ends of the hose barbs projecting through said hose barb mounting plate at axially spaced positions, a suction hose is coupled at one end to the other projecting end of one of said barbs and having the other end of said suction hose opening to the liquid in the container to be sprayed, a discharge hose is connected at one end to the end of said other barb, and wherein said at least one spray nozzle assembly includes a spray nozzle and means for mounting said spray nozzle to said horizontal hose barb mounting bar for effecting orthogonal adjustment to said spray nozzle to vary the height of said nozzle and its lateral position with respect to said chassis and thus the spray pattern and its density, and means for connecting the other end of said discharge hose to said spray nozzle assembly for causing pumped liquid under pressure to spray from said spray nozzle, and wherein said means for adjustably mounting said spray nozzle comprises a sleeve fixed horizontally to said chassis, a horizontal adjustment rod rotatably and slidably mounted within said sleeve, means for clamping said rod at axially adjustable positions within said sleeve to define the vertical plane for the nozzle spray, said spray nozzle assembly further comprising a ring fixed to one end of said horizontal adjustment rod with its axis at right angles thereto, a rigid nozzle tube slidably mounted within said ring for movement axially of said ring and at right angles to the axis of said horizontal adjustment rod, said nozzle assembly being coupled to one end of said rigid nozzle tube and bearing said spray nozzle and means for connecting the free end of said discharge tube to the other end of said rigid nozzle tube and clamping means carried by said ring for clamping said rigid nozzle tube at axially adjustable positions within said ring.

3. The sprayer as claimed in claim 1, further comprising an elongated handle fixed at one end to said chassis at the rear thereof and being upwardly and rearwardly inclined with respect thereto for permitting manual pushing of said wheeled chassis and an L-shaped carrying handle fixedly mounted to said chassis adjacent said hose barb mounting bar and terminating at its upper end in a generally right angle, horizontal portion overlying the center of said chassis to permit said chassis, said container and the container carried thereby to be vertically lifted from the surface to be coated.

4. The sprayer as claimed in claim 2, further comprising an elongated handle fixed at one end to said chassis at the rear thereof and being upwardly and rearwardly inclined with respect thereto for permitting manual pushing of said wheeled chassis and an L-shaped carrying handle fixedly mounted to said chassis adjacent said hose barb mounting bar and terminating at its upper end in a generally right angle, horizontal portion overlying the center of said chassis to permit said chassis, said container and the container carried thereby to be vertically lifted from the surface to be coated.

5. The sprayer as claimed in claim 4, wherein said nozzle assembly comprises a tubular nozzle body threaded to said rigid nozzle tube in axial alignment therewith, a nozzle cap threaded to the end of said threaded tubular nozzle body opposite said rigid nozzle tube and a cylindrical, replaceable nozzle tip concentrically carried by said nozzle cap bearing a nozzle spray opening transversely of the axis of said nozzle tube, protruding through said cap, and said tip being axially pressed against said nozzle body at its opposite end and threadably locked thereto by said nozzle cap.

6. The sprayer as claimed in claim 1, wherein said sprayer comprises dual sprayer nozzle assemblies and each of said laterally spaced sidewalls carry a pair of roller cams fixedly mounted thereto and rotating circumferentially about the axle, and wherein said chassis bears individual hose barb mounting bars overlying portions of said axle inboard of respective side wheels on laterally opposed sides of said chassis, and a pair of hose barbs mounted to said hose barb mounting bar on each side carry on their lower ends respective ends of flexible pump hose which extends about the roller cams of respective wheels and being compressed thereby to form a pair of suction pumps on opposite sides of the sprayer, and said hose barbs having mounted on their upper ends respectively on each side an individual suction hose coupled to the container of liquid and an individual discharge hose leading to respective spray nozzle assemblies on the same side thereof.

7. The sprayer as claimed in claim 6, wherein said chassis includes laterally spaced pusher bar mounting plates extending horizontally from said axle towards the rear of said chassis, said pusher bar supporting plates bear individually bar mounting tubes extending upwardly and rearwardly inclined relative to said plates and an inverted U-shaped pusher having opposite parallel sides with the ends of said pusher bar coaxially received within said sleeves and being fixed thereto and wherein said means mounting said individual spray nozzle assemblies to said chassis comprise sleeves oriented horizontally and fixed to said chassis at said pump mounting bar on opposite sides thereof to the side of said side wheels and bearing clamping means for clamping individual horizontal adjustment rods of said spray nozzle assemblies at axially given positions to define the vertical plane of a common spray pattern provided by said dual spray nozzle assemblies.

* * * * *